US005503049A

United States Patent [19]

Chervenak et al.

[11] Patent Number: 5,503,049

[45] Date of Patent: Apr. 2, 1996

[54] OPPOSED HANDLE HAND TOOL WITH COMPOSITE HANDLE

[75] Inventors: Thomas M. Chervenak, Beatrice; Joseph A. Sorensen, Lincoln, both of Nebr.

[73] Assignee: Petersen Manufacturing Co., Inc., Lincoln, Nebr.

[21] Appl. No.: 261,826

[22] Filed: Jun. 17, 1994

[51] Int. Cl.[6] ..... B25B 7/00

[52] U.S. Cl. ..... 81/427.5; 81/367; 30/341

[58] Field of Search ..... 30/176, 341; 81/366–369, 81/415, 427.5

[56] References Cited

U.S. PATENT DOCUMENTS

| | | | |
|---|---|---|---|
| 1,728,619 | 9/1929 | Lambert . | |
| 2,985,209 | 5/1961 | Novelo . | |
| 3,859,874 | 1/1975 | Joeckel | 81/367 |
| 4,837,892 | 6/1989 | Lo . | |
| 5,099,546 | 3/1992 | Mackal . | |
| 5,141,353 | 8/1992 | Meredith et al. . | |

FOREIGN PATENT DOCUMENTS

| | | | |
|---|---|---|---|
| 2053071 | 2/1981 | United Kingdom | 81/427.5 |

*Primary Examiner*—James G. Smith

*Attorney, Agent, or Firm*—Willian Brinks Hofer Gilson & Lione

[57] ABSTRACT

A locking pliers includes first and second handles. The first handle includes two spaced, parallel plates and a jaw received therebetween. The plates and at least a portion of the jaw are surrounded by a molded plastic element that defines the hand engaging surface of a handle. A similar construction can be used for the second handle. The plates provide rigidity to the handle, while the molded plastic element provides an ergonomically shaped hand engaging surface. The disclosed handles can be adapted for use in other hand tools, including pliers, wire cutters, snips, and the like.

21 Claims, 3 Drawing Sheets

FIG. 8
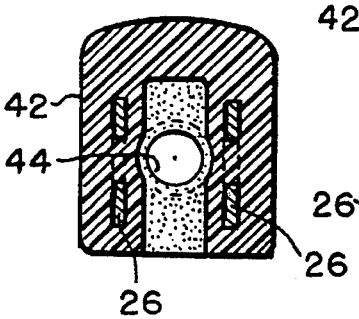
FIG. 9
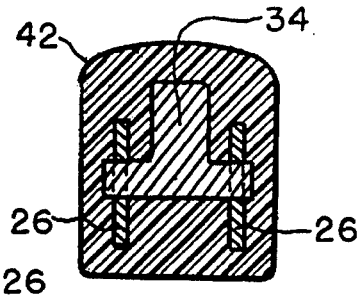
FIG. 10
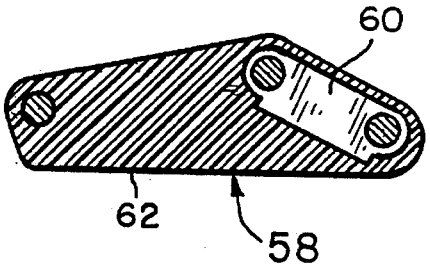
FIG. 11
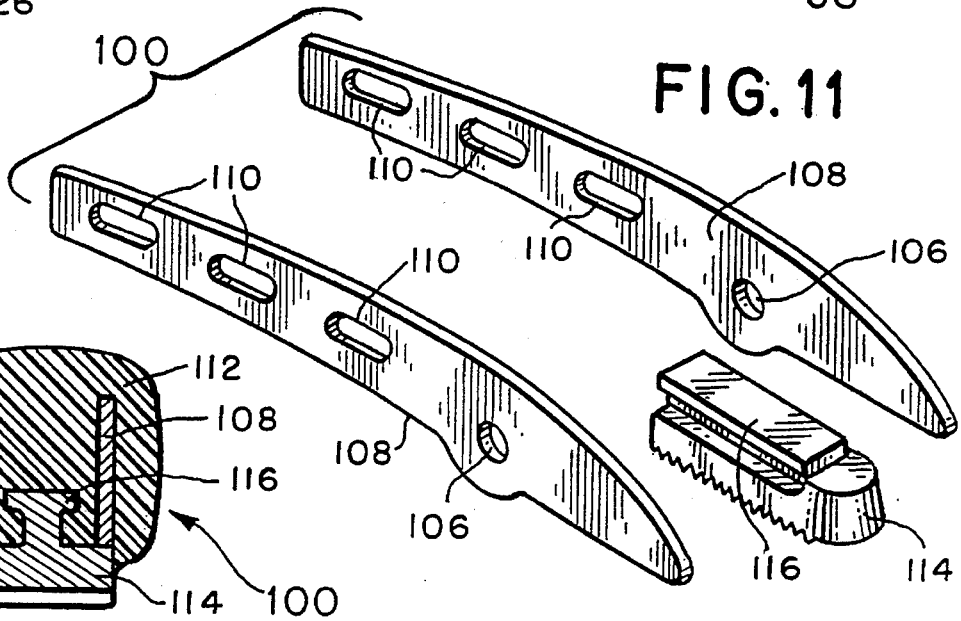
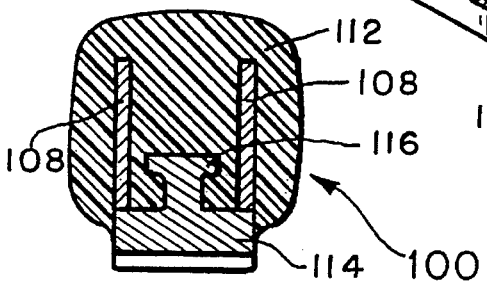
FIG. 13
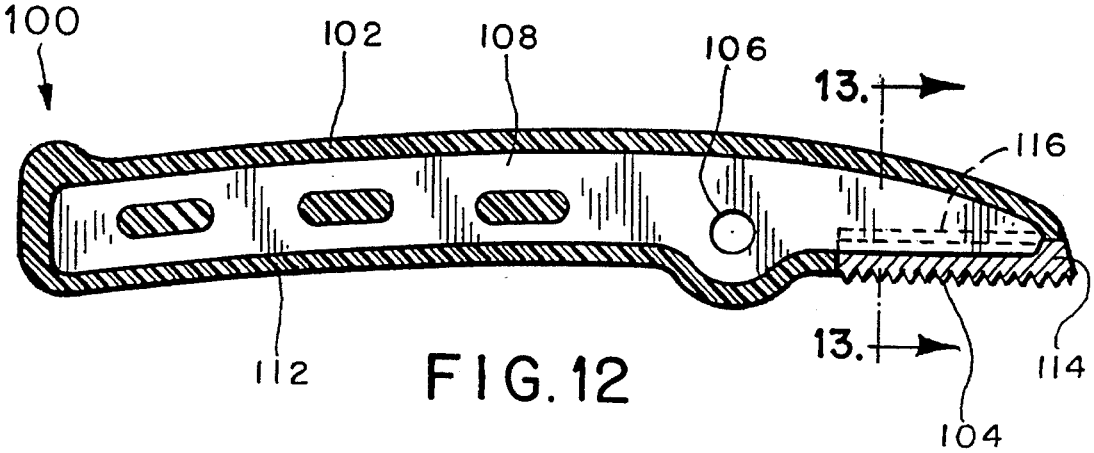
FIG. 12

OPPOSED HANDLE HAND TOOL WITH COMPOSITE HANDLE

BACKGROUND OF THE INVENTION

This invention relates to opposed handle hand tools, and in particular to such tools with improved handles.

Conventional opposed handle hand tools such as locking pliers typically have handles formed of stamped metal parts. Such handles are strong and reliable, and they have generally been found suitable for a wide range of applications. Nevertheless, stamped metal parts are limited in the range of handle shapes that can be provided in a cost-effective manner. It would be advantageous if cost-effective approaches for making ergonomically shaped handles for such hand tools were available.

Opposed handle hand toots such as snips have used cast metal handles in the past. Such handles provide adequate strength, and because they are cast the handle shape can easily be adapted for the application. Such cast metal handles are, however, relatively expensive and heavy in many applications. It would also be advantageous if the limitations of cast metal handles for such tools could be avoided.

SUMMARY OF THE INVENTION

According to this invention, an opposed handle hand tool is provided comprising first and second handles. Each of the handles has a hand engaging surface and a workpiece engaging surface. pivot joint interconnects the first and second handles, such that the hand engaging surfaces are opposed for gripping by a user and the workpiece engaging surfaces are opposed for applying forces to a workpiece. The first handle comprises two spaced, generally parallel plates positioned alongside one another, a jaw positioned adjacent to the plates to bridge the plates, and a molded plastic element formed around at least a portion of the plates. The molded plastic element forms at least a portion of the hand engaging surface of the first handle, and the jaw forms at least a portion of the workpiece engaging surface of the first handle. The plates provide increased bending resistance to the first handle.

This invention allows a hand tool to be provided with an ergonomically formed handle while still providing adequate strength in a cost-effective manner. The plates provide increased bending resistance to the handle while the molded plastic element allows the hand engaging surface to be formed as desired at low cost.

BRIEF DESCRIPTION OF THE DRAWINGS

FIG. 8 is a cross-sectional view taken along line 8—8 of FIG. 7.

FIG. 9 is a cross-sectional view taken along line 9—9 of FIG. 7.

FIG. 10 is a cross-sectional view taken along line 10—10 of FIG. 3, showing one selected element of the locking pliers of FIG. 3.

FIG. 11 is an exploded perspective view of the metal components of a handle suitable for use in a second preferred embodiment of this invention.

FIG. 12 is a longitudinal sectional view of a handle using the components of FIG. 11.

FIG. 13 is a cross sectional view taken along line 13—13 of FIG. 12.

DETAILED DESCRIPTION OF THE PRESENTLY PREFERRED EMBODIMENTS

Turning now to the drawings, FIGS. 1 through 10 relate to an opposed handle hand tool 10 which incorporates a first preferred embodiment of this invention. In this embodiment the hand tool 10 is a locking pliers.

Figure 1:
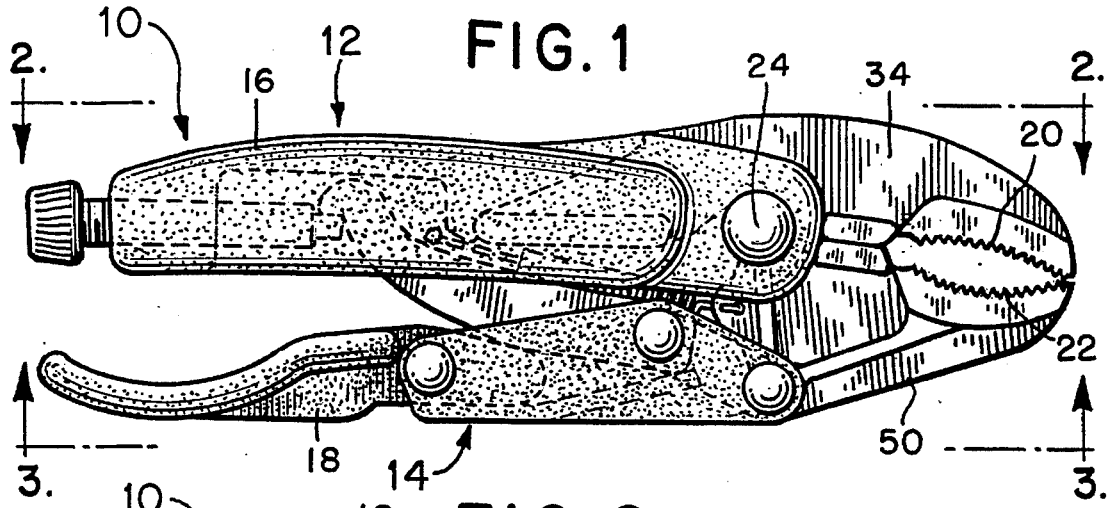
FIG. 1 is a side view of a locking pliers which incorporates a first preferred embodiment of this invention.
Figure 2:
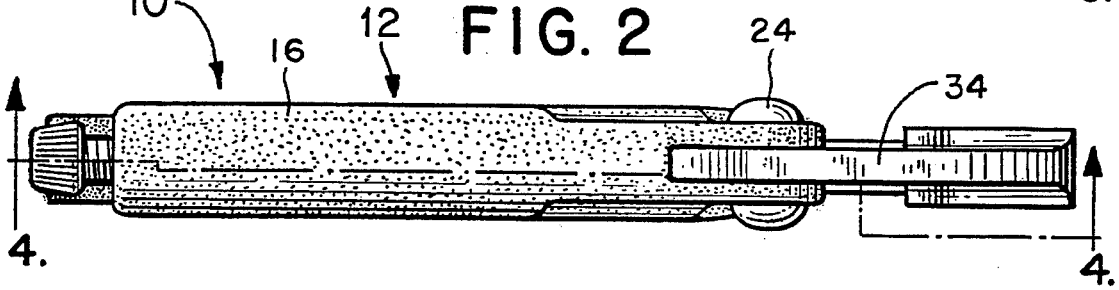
FIG. 2 is a top view taken along line 2—2 of FIG. 1.
Figure 3:
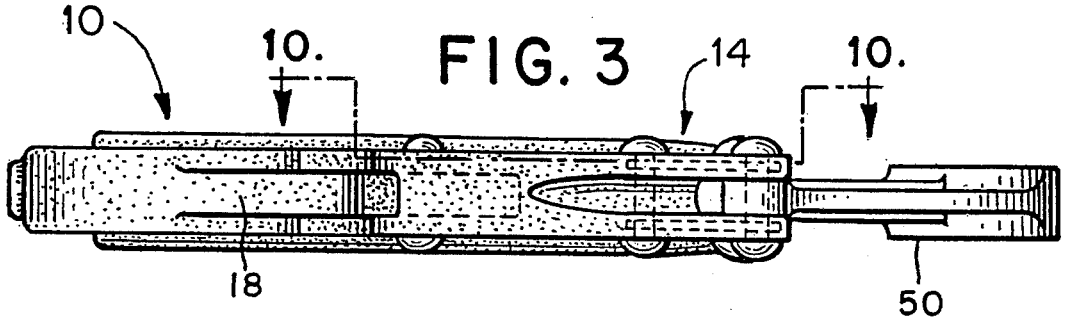
FIG. 3 is a bottom view taken along line 3—3 of FIG. 1.

The hand tool 10 includes first and second handles 12, 14 (FIG. 1). The first handle 12 defines a hand engaging surface 16 and a workpiece engaging surface 20. The second handle 14 defines a second hand engaging surface 18 and a second workpiece engaging surface 22.

Figure 4:
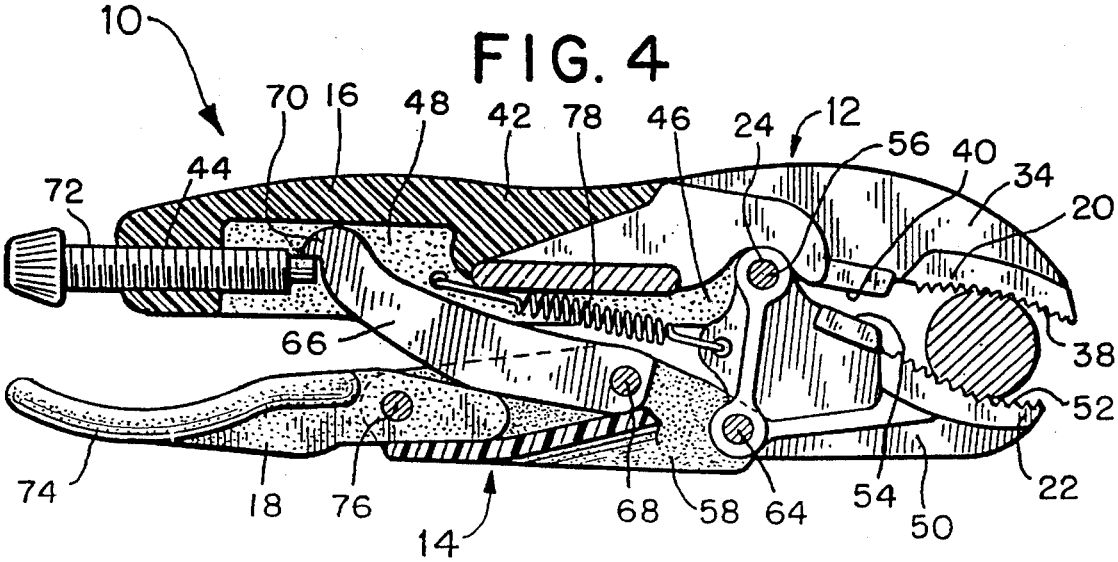
FIG. 4 is a cross-sectional view taken along line 4—4 of FIG. 2.

A pivot joint 24 interconnects the first and second handles 12 and 14 such that the hand engaging surfaces 16, 18 are opposed for gripping by a user, and the workpiece engaging surfaces 20, 22 are opposed for engaging a workpiece (FIG. 4).

Figure 5:
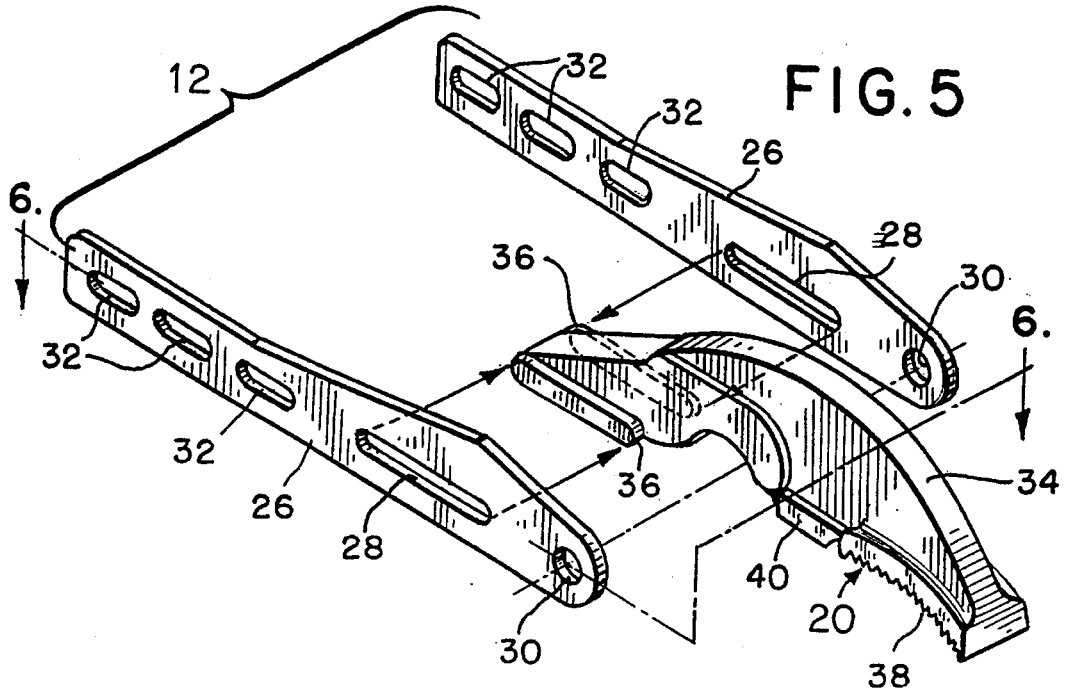
FIG. 5 is an exploded perspective view showing portions of the locking plier of FIG. 1 at an intermediate step in fabrication.

As best shown in FIG. 5, the handle 12 includes two spaced, parallel plates 26 situated alongside one another. The plates 26 each define an opening 28, a pivot pin opening 30, and an array of through holes 32. In this embodiment, the plates 26 are planar in configuration and are readily stamped from metal plate stock.

The first handle 12 also includes a first jaw 34 that in this embodiment is formed preferably as a forging. The jaw 34 includes a pair of opposed protrusions 36, each shaped to fit snugly within a respective one of the openings 28. The jaw 34 also defines a toothed surface 38 and a wire cutter surface 40, which together make up the first workpiece engaging surface 20.

The first handle 12 also includes a molded plastic element 42 (FIGS. 7–9) which is molded around the plates 26 and a portion of the jaw 34. The molded plastic element 42 defines a threaded bore 44 at one end, a recess 46 in the region of the pivot joint 24, and a recess 48 between the plates (FIG. 4). If desired, the threaded bore can be formed in a metal part such as a threaded collar or nut molded in the plastic element 42. As described below, the plates 26 and the jaw 34 (FIG. 4) are preferably insert molded in the molded plastic element 42, and the molded plastic element 42 fills the through holes 32 and holds the entire assembly together. The molded plastic element 42 forms the first hand engaging surface 16 of the first handle 12.

As best shown in FIGS. 1 and 4, the second handle 14 includes a second jaw 50 which in this embodiment is also a forging with a toothed surface 52 and a wire cutter surface 54 that form the second workpiece engaging surface 22.

The second jaw 50 fits between the plates 26 in the recess 46 and defines an opening that receives a pivot pin 56 such that the second jaw 50 is pivotably mounted to the first handle 12 by the pivot pin 56.

A locking lever 58 is pivotably mounted to the second jaw 50 by a pivot pin 64. This locking lever 58 includes two spaced, parallel metal plates 60 which are insert molded within a molded plastic element 62 (FIG. 10). A stub shaft 66 is provided as shown in FIG. 4, and the stub shaft 66 is preferably formed of stamped metal. Alternately, the stub shaft 66 can be molded of a suitable thermoplastic material. The stub shaft 66 is pivotably attached to the locking lever 58 by a pivot pin 68. The stub shaft 66 fits between the plates 60 (not shown in FIG. 4, but positioned above and below the plane of FIG. 4, extending between the pins 64, 68), and defines an opening to receive the pivot pin 68.

The free end 70 of the stub shaft 66 bears on an adjusting screw 72 received in the threaded bore 44 of the molded plastic element 42. Rotation of the adjusting screw 72 in the threaded bore 44 adjusts the position of the free end 70 of the stub shaft 66, and thereby the position of the second jaw 50 with respect to the first jaw 34 when the second handle 14 is closed. The second jaw 50, locking lever 58, stub shaft 66 and adjusting screw 72 form an over-center locking linkage similar to that used in conventional locking pliers.

A release lever 74 is provided which may be formed as a molded thermoplastic element. The release lever 74 is pivotably mounted to the locking lever 58 by a pivot pin 76. The release lever 74 is shaped such that clockwise rotation of the release lever 74 with respect to the locking lever 58 is prevented from the position of FIG. 4. However, counter-clockwise rotation of the release lever 74 from the position of FIG. 4 moves the pivot pin 76 away from the stub shaft 66 to release the over-center locking linkage. The outer surfaces of the release lever 74 and locking lever 58 form the second hand engaging surface 18. A spring 78 is coupled between the second jaw 50 and the handle 12 to bias the second jaw 50 open.

Figure 6:
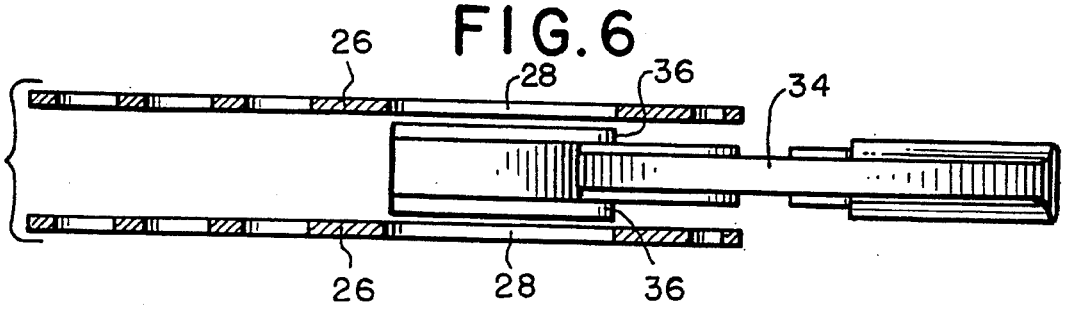
FIG. 6 is a cross sectional view taken along line 6—6 of FIG. 5.
Figure 7:
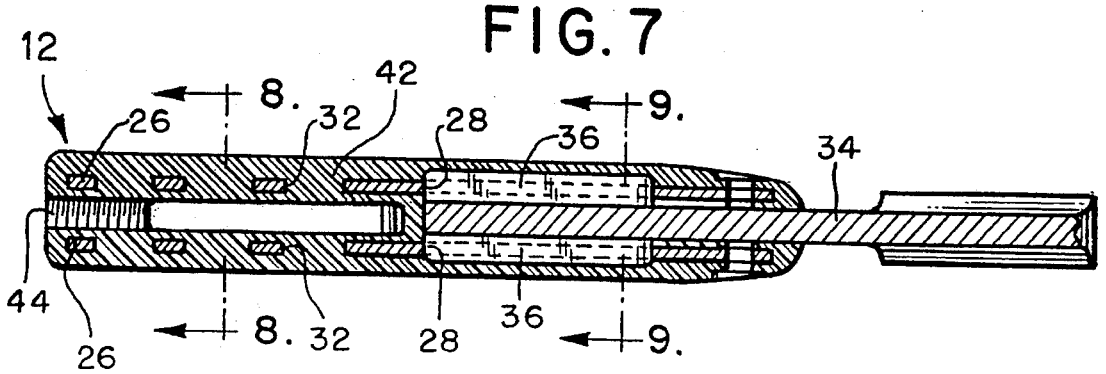
FIG. 7 is a cross sectional view in the plane of FIG. 6 after the plastic molding operation has been completed.

FIGS. 5–7 provide further details of the preferred method for forming the first handle 12. As shown in FIGS. 5 and 6, the plates 26 are first moved into position on the jaw 34, with the jaw protrusions 36 received in the openings 28. This assembly is then used as an insert in an insert molding operation that forms the molded plastic element 42 around the plates 26 and a portion of the jaw 34 (FIG. 7). The plates 36 are mechanically interlocked and thereby coupled to the jaw 34 by the protrusions 36 and the openings 28. In this way, the plates 26 provide excellent bending resistance to the handle 12. The plastic element 42 is molded, and therefore can readily be provided with a desired ergonomic shape.

FIGS. 11–13 relate to a handle 100 for a second preferred embodiment of this invention. This handle 100 is adapted for use in pliers such as locking pliers, and it includes a hand engaging surface 102 and a workpiece engaging surface 104. The handle 100 defines a through opening 106 for a pivot pin (not shown) used to connect the handle 100 with another handle (not shown), that may be similar to the handle 14 of FIG. 1.

The handle 100 includes two spaced, parallel plates 108, each of which is provided with holes 110 (FIG. 11). A molded plastic element 112 is formed around the plates 108. The handle 100 includes a jaw 114 which includes a retainer 116 that extends between the plates 108. The retainer 116 is shaped such that the molded plastic element 112 secures the jaw 114 in the handle 100. The jaw 114 bears on the plates 108 to transmit compressive loads to the plates 108.

The handle 100 differs significantly from the handle 12 described above in that the plates 108 of the handle 100 extend on both sides of the opening 106 for the pivot pin (not shown) to a substantial extent. In contrast, the plates 26 of the tool 10 do not extend substantially to the jaw side of the pivot joint 24, but are instead mechanically engaged with the jaw 34 on the same side of the pivot joint 24 as the hand engaging surface 16.

The tools described above provide important advantages. The handles can be ergonomically shaped, and an elastomer can readily be molded or bonded on the plastic of the handles to provide a greater degree of user comfort. All metal parts can be formed of stainless steel if desired, thereby reducing or eliminating plating requirements. The tools described above provide these advantages in a cost-effective manner.

Of course, it should be understood that a wide range of changes and modifications can be made to the preferred embodiments described above. For example, this invention can readily be adapted to other types of opposed handle hand tools such as other types of pliers, wire cutters, snips, crimping tools, and the like. Also, other types of pivot joints can be used such as compound pivot joints of the type customarily used in aviation snips, and arcuate channel and arcuate ridge pivot joints. Additionally, it is not essential in all applications that the plates be formed as separate discrete elements. Instead, if desired, a one piece element can be provided that defines the two plates and includes a web interconnecting the two plates. The plates do not have to be precisely parallel, and the term "generally parallel" is intended to cover arrangements in which the plates are spaced somewhat more closely at one end than the other.

Additionally, materials can be varied widely. A wide range of thermoplastic and thermosetting plastics can be used, with or without reinforcing materials such as glass or carbon fibers, and with or without setting agents such as epoxy.

When the invention is applied to locking pliers, a wide variety of locking linkages can be used, including other types of stub shafts such as those having an integral length adjustment. With this approach the need for an adjusting screw in the handle can be eliminated. Also, other types of release mechanisms can be used, such as the release lever of conventional locking pliers.

Simply by way of example, the following information is provided better to define the best mode of this invention. The plates 26, 108 can be stamped of a suitable metal such as an alloy or stainless steel in a thickness of about 0.062 inches. The jaws 34, 50, 114 can be forged of a suitable metal such as an alloy or stainless steel and can be plated if desired. The molded plastic elements 42, 62, 112 can be formed of a material such as a glass reinforced nylon, though other materials are, of course, suitable.

It should be apparent from the foregoing that an improved opposed handle hand tool has been described which combines the ergonomic advantages of a molded plastic element that defines a hand engaging surface with the strength advantages of plates. Because two plates are used in a spaced, generally parallel arrangement, the handle described above is well balanced and can readily apply clamping forces from the hand engaging surface to the workpiece engaging surface without twisting moments. Also, because the plates 26, 108 are spaced and separated from one another, they can readily form a balanced pivot joint with a second jaw positioned between the plates and pivotably mounted in place with a pivot pin.

The foregoing detailed description is intended to illustrate the invention and to define it. Many changes and modifications can be made to the preferred embodiments described above, and it is therefore intended that the following claims, including all equivalents, be understood as defining the invention.

We claim:

1. An opposed handle hand tool comprising:

first and second handles, each comprising a respective hand engaging surface and a respective workpiece engaging surface;

a pivot joint interconnecting the first and second handles, said pivot joint positioned to oppose the hand engaging surfaces for gripping by a user and to oppose the workpiece engaging surfaces for applying forces to a workpiece;

said first handle comprising two spaced, generally parallel plates positioned alongside one another, a jaw positioned adjacent to the plates to bridge the plates, and a molded plastic element formed around at least a portion of the plates;

said spaced, generally parallel plates extending to the pivot joint;

said molded plastic element forming at least a portion of the hand engaging surface of the first handle;

said jaw forming at least a portion of the workpiece engaging surface of the first handle;

said plates providing increased bending resistance to the first handle adjacent to the hand engaging surface of the first handle.

2. The invention of claim 1 wherein the jaw comprises a pair of protruding elements, wherein the plates define openings positioned to receive the protruding elements, and wherein the jaw extends between the plates, with the protruding elements positioned in the respective openings to couple the jaw rigidly to the plates.

3. The invention of claim 2 wherein the hand engaging surface and the workpiece engaging surface of the first handle are positioned on opposed first and second sides of the pivot joint, respectively, and wherein the protruding elements are positioned on the first side of the pivot joint.

4. The invention of claim 1 wherein the plates define respective first pivot pin openings, wherein a portion of the second handle extends between the plates adjacent to the pivot pin openings and defines a second pivot pin opening, and wherein the pivot joint comprises a pivot pin received in the first and second pivot pin openings.

5. The invention of claim 1 wherein the hand tool is a locking pliers; wherein the molded plastic element comprises a threaded bore extending between the plates; wherein the second handle comprises a second jaw pivotally mounted to the first handle, a locking lever pivotably mounted to the second jaw, and a stub shaft pivotably mounted to the locking lever; and wherein an adjustment screw is threaded in the threaded bore to engage the stub shaft between the plates.

6. The invention of claim 5 wherein the locking lever comprises a pair of spaced, generally parallel locking lever plates positioned alongside one another to extend at least between the stub shaft and the second jaw; and a locking lever molded plastic element formed around at least a portion of the locking lever plates.

7. The invention of claim 1 wherein the molded plastic element is positioned partly around the jaw.

8. The invention of claim 1 wherein the plates extend closely adjacent to the workpiece engaging surface of the jaw, and wherein the jaw extends between the plates.

9. The invention of claim 8 wherein the jaw is mechanically interlocked with the molded plastic element to retain the jaw in place in the first handle.

10. An opposed handle hand tool comprising:

first and second handles, each comprising a respective hand engaging surface and a respective workpiece engaging surface;

a pivot joint interconnecting the first and second handles, said pivot joint positioned to oppose the hand engaging surfaces for gripping by a user and to oppose the workpiece engaging surfaces for applying forces to a workpiece;

said first handle comprising two spaced, generally parallel plates positioned alongside one another, a jaw positioned adjacent to the plates to bridge the plates, and a molded plastic element formed around at least a portion of the plates;

said molded plastic element forming at least a portion of the hand engaging surface of the first handle;

said jaw forming at least a portion of the workpiece engaging surface of the first handle;

said plates providing increased bending resistance to the first handle adjacent to the hand engaging surface of the first handle;

wherein the plates define through holes, and wherein the molded plastic element extends into the through holes to interlock the molded plastic element mechanically with the plates.

11. The invention of claim 1 wherein the two plates are separate metallic elements.

12. A locking pliers comprising:

a handle comprising two spaced, generally parallel plates positioned alongside one another, a first jaw positioned in part between the plates and extending away from the plates to form a workpiece engaging surface, and a molded plastic element formed around at least a portion of the plates to form a hand engaging surface, wherein said plates provide increased bending resistance to the first handle;

a second jaw pivotably mounted to the first handle by a pivot joint;

a locking lever pivotably mounted to the second jaw; and a stub shaft pivotably mounted to the locking lever and positioned to bear on the handle said spaced, generally parallel plates extending to the pivot joint.

13. The invention of claim 12 further comprising:

an adjustment screw threaded into the handle between the plates, said adjustment screw having a free end that bears on the stub shaft between the plates.

14. The invention of claim 13 wherein the molded plastic element defines a threaded bore that receives the adjustment screw.

15. The invention of claim 12 wherein the first jaw comprises a pair of protruding elements, wherein the plates define openings positioned to receive the protruding elements, and wherein the first jaw extends between the plates, with the protruding elements positioned in the respective openings to couple the first jaw rigidly to the plates.

16. The invention of claim 15 wherein the hand engaging surface and the workpiece engaging surface of the handle are positioned on opposed first and second sides of the pivot joint, respectively, and wherein the protruding elements are positioned on the first side of the pivot joint.

17. The invention of claim 16 wherein the plates define respective first pivot pin openings, wherein a portion of the second jaw extends between the plates adjacent to the pivot pin openings and defines a second pivot pin opening, and wherein the pivot joint comprises a pivot pin received in the first and second pivot pin openings.

18. The invention of claim 12 wherein the locking lever comprises a pair of spaced, generally parallel locking lever plates positioned alongside one another to extend at least between the stub shaft and the second jaw; and a locking lever molded plastic element formed around at least a portion of the locking lever plates.

19. The invention of claim 12 wherein the plates extend closely adjacent to the workpiece engaging surface of the first jaw, and wherein the first jaw extends between the plates.

20. The invention of claim 19 wherein the first jaw is mechanically interlocked with the molded plastic element to retain the first jaw in place in the handle.

21. A locking pliers comprising:

a handle comprising two spaced, generally parallel plates positioned alongside one another, a first jaw positioned in part between the plates and extending away from the plates to form a workpiece engaging surface, and a molded plastic element formed around at least a portion of the plates to form a hand engaging surface, wherein said plates provide increased bending resistance to the first handle;

a second jaw pivotably mounted to the first handle by a pivot joint;

a locking lever pivotably mounted to the second jaw; and a stub shaft pivotably mounted to the locking lever and positioned to bear on the first handle;

wherein the plates define through holes, and wherein the molded plastic element extends into the through holes to interlock the molded plastic element mechanically with the plates.

* * * * *